US011624131B2

(12) United States Patent
Zeng

(10) Patent No.: US 11,624,131 B2
(45) Date of Patent: Apr. 11, 2023

(54) METHOD FOR PREPARING MICROPOROUS PVA FIBER

(71) Applicant: Zhejiang Hongyu Medical Commodity Co., Ltd., Zhejiang (CN)

(72) Inventor: Juhong Zeng, Zhejiang (CN)

(73) Assignee: Zhejiang Hongyu Medical Commodity Co., Ltd., Jinhua (CN)

( * ) Notice: Subject to any disclaimer, the term of this patent is extended or adjusted under 35 U.S.C. 154(b) by 266 days.

(21) Appl. No.: 17/144,103

(22) Filed: Jan. 7, 2021

(65) Prior Publication Data

US 2021/0214860 A1 Jul. 15, 2021

(30) Foreign Application Priority Data

Jan. 9, 2020 (EP) ..... 20150824

(51) Int. Cl.

| | |
|---|---|
| ***D01D 7/00*** | (2006.01) |
| ***D01F 6/14*** | (2006.01) |
| ***D01D 1/02*** | (2006.01) |
| ***D01D 5/06*** | (2006.01) |
| ***D01D 10/02*** | (2006.01) |
| ***D01D 10/06*** | (2006.01) |
| ***D01F 11/06*** | (2006.01) |
| ***D01D 5/247*** | (2006.01) |
| ***D01F 1/08*** | (2006.01) |

(52) U.S. Cl.

CPC ..... *D01F 6/14* (2013.01); *D01D 1/02* (2013.01); *D01D 5/06* (2013.01); *D01D 5/247* (2013.01); *D01D 10/02* (2013.01); *D01D 10/06* (2013.01); *D01F 1/08* (2013.01); *D01F 11/06* (2013.01); *D10B 2321/06* (2013.01); *D10B 2401/10* (2013.01)

(58) Field of Classification Search

CPC D01D 1/02; D01D 5/06; D01D 5/247; D01D 10/02; D01D 10/06; D01F 6/14; D10B 2321/06; D10B 2401/10

USPC ..... 264/51, 54, 185, 211.15, 233, 234

See application file for complete search history.

(56) References Cited

FOREIGN PATENT DOCUMENTS

CN 112921431 A 6/2021

*Primary Examiner* — Leo B Tentoni

(57) ABSTRACT

The present application discloses a method for preparing microporous PVA fiber comprising the following steps: Step 1: preparing spinning solution, calcium hydroxide solution, and sodium sulfate solution; Step 2: cooling the spinning solution to 40-60° C., and adding a foaming agent thereto to provide the PVA spinning stock solution; Step 3: spinning into the sodium sulfate solution so that the fiber containing the reaction product of the foaming agent and the mirabilite is dehydrated to provide a primary PVA fiber; Step 4: reacting the fiber with the calcium hydroxide solution to provide a secondary fiber; Step 5: foaming and pore forming; and Step 6: cleaning and drying to provide the final product of microporous PVA fiber.

10 Claims, No Drawings

METHOD FOR PREPARING MICROPOROUS PVA FIBER

CROSS REFERENCE TO RELATED APPLICATIONS

The present application claims the priority to European Patent Application No. 20150824.9 filed on Jan. 9, 2020, which is incorporated herein by reference in its entirety for all purposes.

TECHNICAL FIELD

The present application relates to the field of PVA preparation, and in particular, to a method for preparing a microporous PVA fiber.

BACKGROUND

A polyvinyl alcohol (PVA) fiber is widely used not only in building materials but also in medical materials, due to the advantages of high strength, high modulus, wear resistance, acid and alkali resistance, and excellent weatherability, as well as non-toxicity, free of pollution, no damage to human skin or harmless to human body. However, the PVA fiber suffers from the disadvantage of poor dimensional stability and obvious water shrinkage. At present, the disadvantages of poor dimensional stability and water shrinkage suffered by the PVA fiber are generally addressed by adding a filler during the process of dissolving or melting the PVA resin.

However, during adding a filler directly, the phenomenon of precipitation often occurs due to different specific weight of the directly added fillers, especially in the case of adding a filler to the spinning stock solution, where the phenomenon of spinneret plugging often occurs.

In the traditional production process of PVA fiber, the spinned fiber is dehydrated by a coagulation bath in sodium sulfate solution, then cleaned, and finally dried. In the traditional wet spinning process of PVA fiber, mirabilite solution (i.e. sodium sulfate solution) is usually used to quickly dehydrate the PVA stock solution, that is, performing coagulation bath treatment. Sodium sulfate will remain on the surface and inside of PVA fiber treated by the coagulation bath treatment of sodium sulfate solution.

Due to the use of sodium sulfate (a strong electrolyte) as the coagulation bath treatment material of the fiber formed by the spinning of PVA spinning stock solution, the water absorption of sodium sulfate can quickly remove the water absorbed on the surface of PVA fiber due to the water absorption of PVA fiber, but the removal effect of the water inside the fiber is relatively weak, so that the surface of PVA fiber is relatively dense and the interior of PVA fiber is porous, forming an obvious skin-core structure. The PVA fiber with a skin-core structure has relatively strong mechanical properties, however, it imposes a great limitation to the —OH group on the side chains of PVA fiber due to the strong interaction between the molecules in the dense skin layer on the surface, which results in the significant decrease of hydrophilic ability of final PVA fiber. Therefore, the use of PVA fiber prepared by the above method in the medical field is greatly limited since a medical material needs good hydrophilic property.

Furthermore, there is considerable amount of sodium sulfate contained on the surface and inside of the PVA fiber prepared by this process, which is a strong electrolyte and tends to cause damage to the human body upon contact with skin, resulting in that the PVA fiber cannot be applied to the damaged skin or wound, and thus limiting the application of PVA fiber in the field of medical materials.

In conclusion, the PVA fiber prepared by the above traditional process cannot be applied to the field of medical materials.

BRIEF SUMMARY

The present application provides a method for preparing microporous PVA fiber, by which the prepared microporous PVA fiber has not only good mechanical properties but also excellent hydrophilic properties, and further has greatly reduced content of sodium sulfate on the surface and inside of the microporous PVA fiber, so that it has low irritation to the skin or wounds, being suitable for use in the field of medical materials.

In one embodiment, the present application provides the following technical solution:

a method for preparing microporous PVA fiber comprising the following steps:

Step 1: preparing a spinning solution: mixing raw material PVA resin with water and heating to dissolve the raw material PVA resin completely to form the spinning solution;

preparing calcium hydroxide solution: mixing calcium hydroxide powder with water to form the calcium hydroxide solution; and preparing sodium sulfate solution: forming the sodium sulfate solution with a concentration of 35% from mirabilite and water;

Step 2: preparing PVA spinning stock solution: cooling the spinning solution obtained in Step 1 to 40-60° C., and adding a foaming agent thereto to provide the PVA spinning stock solution;

Step 3: spinning and first coagulation bath treatment: spinning the PVA spinning stock solution obtained in Step 2, and subjecting the spinned fiber to a first coagulation bath treatment in the sodium sulfate solution for dehydration to provide a primary PVA fiber;

Step 4: second coagulation bath treatment: reacting the primary PVA fiber obtained in Step 3 with the calcium hydroxide solution to provide a secondary fiber;

Step 5: foaming and pore forming: heating to foam the secondary fiber obtained in Step 4 while stretching to form a primary product of microporous PVA fiber; and Step 6: cleaning and drying the primary products of microporous PVA fiber obtained in Step 5 to provide the final product of microporous PVA fiber;

wherein the foaming agent is one selected from the group consisting of ammonium carbonate and ammonium bicarbonate.

In the above technical solution, in Step 1, the spinning solution, calcium hydroxide solution and sodium sulfate solution are separately preparing for use, which, on the one hand, facilitates subsequent operations and provides a continuous whole operation, and on the other hand, improves the purity of the prepared solution and reduces the influence on the effect of preparation by reducing the introduction of other impurities.

In Step 2, the spinning solution is cooled to 40-60° C. so that it becomes the state of slight gelation, and then ammonium bicarbonate or ammonium carbonate is added as the foaming agent to blend with the spinning solution in the state of gentle gelation to form the PVA spinning stock solution, by which the state of the PVA spinning stock solution is maintained, since the temperature at this time is not enough to decompose the foaming agent and produce a large amount of gas.

In Step 3, the spinning is performed by passing the PVA spinning stock solution through a spinneret plate or the like, and the spinned fiber is immediately placed in the sodium sulfate solution. It is to note that, the whole preparation process is continuously performed in a workshop, and, in order to provide a better effect of dehydration in the first coagulation bath treatment in Step 3, it is necessary to keep the concentration of sodium sulfate solution at 35%. For this reason, in a conventional preparing process, sodium sulfate has to be continuously added to keep the concentration of the sodium sulfate solution at 35% since the sodium sulfate in the sodium sulfate solution will be continuously reduced by reacting with the foaming agent. If the concentration of the original sodium sulfate solution used here is 35%, and there is no sodium sulfate added after performing the first coagulation bath treatment to the spinned fiber, the content of sodium sulfate in the sodium sulfate solution will continue to decrease and even run out. Therefore, the waste water thus produced will not tend to cause great pollution to the environment due to the high content of sodium sulfate.

When using ammonium bicarbonate as the foaming agent, there is ammonium bicarbonate contained on the surface and inside of the fiber, in which the ammonium bicarbonate on the surface of the fiber reacts with sodium sulfate to form sodium bicarbonate and ammonium sulfate. When using ammonium bicarbonate as the foaming agent, there is ammonium carbonate contained on the surface and inside of the fiber, in which part of the foaming agent reacts with sodium sulfate to form sodium carbonate and ammonium sulfate, thus reducing the content of sodium sulfate, which is beneficial to reduce the adhesion of sodium sulfate on the formed PVA primary fiber and in turn the adverse effect on subsequent operations. Further, this operation is also conducive to reducing the pollution of sodium sulfate to the environment and the difficulty of water treatment.

When using ammonium bicarbonate as the foaming agent, the reaction formula is as follows:

$$2NH_4HCO_3+Na_2SO_4=2NaHCO_3+(NH_4)_2SO_4;$$

When using ammonium carbonate as the foaming agent, the reaction formula is as follows:

$$(NH_4)_2CO_3+Na_2SO_4=Na_2CO_3+(NH_4)_2SO_4.$$

In Step 4, the calcium hydroxide is excessively used. When the calcium hydroxide solution is reacted with the ammonium sulfate generated in Step 3, pure and impurity free calcium sulfate is generated. Therefore, whether the foaming agent is ammonium bicarbonate or ammonium carbonate, the reaction represented by the following formula will occur in Step 4:

$$Ca(OH)_2+(NH_4)_2SO_4=CaSO_4+2NH_3\uparrow+2H_2O.$$

Meanwhile, when the foaming agent is ammonium carbonate, the sodium carbonate formed by the reaction of ammonium carbonate and sodium sulfate will react with calcium hydroxide to produce calcium carbonate.

Since the calcium sulfate or calcium carbonate can form a strong interaction with the hydroxyl group on the molecular chain of the PVA fiber to limit the movement of the molecular chain while confining plasticizer molecules, the size increasing or reducing phenomenon of the PVA fiber can be reduced and in turn the mechanical properties and size stability of the PVA fiber can be improved.

On the contrary, if calcium sulfate is directly added to PVA fiber, it will precipitate due to the high specific gravity thereof, which results in the uneven dispersion of the added calcium sulfate, preventing the calcium sulfate from being uniformly combined with the primary fiber. If calcium sulfate is directly added, the effect will be influenced by the purity of the added calcium sulfate. There are many methods for preparing sodium sulfate, but most of them will still produce considerable amount of by-products or impurities, which will affect the purity of calcium sulfate. In this application, the substances added in all steps are of high purity, and the PVA resin as treated will not produce other by-products. Therefore, the final calcium sulfate formed by reaction has high purity, which plays a key role in improving the mechanical properties of the final microporous PVA fiber.

During the reacting process of the present application, sodium bicarbonate and ammonium sulfate can be generated from the reaction of the foaming agent, that is, ammonium bicarbonate, and sodium sulfate, or sodium carbonate and ammonium sulfate can be generated from the reaction of the foaming agent, that is, ammonium carbonate and sodium sulfate. The preparing method terminates at Step 4, with the obtained secondary fiber containing ammonia gas, carbon dioxide gas, foaming agent (ammonium bicarbonate or ammonium carbonate), and sodium bicarbonate or sodium carbonate formed by reaction. In Step 5, after the heating treatment, the foaming agent (ammonium bicarbonate or ammonium carbonate) and sodium bicarbonate or sodium carbonate formed by reaction will generate a large number of air bubbles, so that the formed primary product of the microporous PVA fiber contains a large number of micropores. At the same time, with the generation of large number of air bubbles by the foaming agent (ammonium bicarbonate or ammonium carbonate) and the sodium bicarbonate or sodium carbonate produced by reaction, the escaping of ammonia and carbon dioxide from the secondary fiber can also form a large number of micropores on the surface of the primary products of microporous PVA fiber, and finally form a large number of micropores on the surface and inside of the primary product of microporous PVA fiber, effectively improving the hydrophilicity of the primary product of microporous PVA fiber. Compared with the PVA fiber prepared by a conventional process, the primary product of microporous PVA fiber in which a large number of micropores are formed on the surface thereof has a slightly reduced mechanical property, but it is still good enough to meet the requirements of mechanical strength of the PVA fiber as a medical material. In addition, in Step 5, although sodium bicarbonate or sodium carbonate can also be thermally decomposed to produce bubbles, the foaming effect thereof is not as good as that of ammonium bicarbonate, due to which the foaming effect is produced by the coordination of sodium bicarbonate or sodium carbonate acting as a foaming assistant with ammonium bicarbonate acting as the foaming agent in Step 5, so that the foaming process lasts longer and more micropores are formed in the primary product of microporous PVA fiber.

It is further preferable that, the foaming agent in Step 2 is preferably ammonium bicarbonate.

In this embodiment, ammonium bicarbonate is easier to be thermally decomposed, facilitating the generation of bubbles and the formation of a primary product of microporous PVA fiber having more micropores. Moreover, ammonium bicarbonate, sodium bicarbonate and sodium carbonate cooperate with each other to provide a long-lasting bubbling effect.

It is further preferable that, in Step 2, the weight ratio of the PVA resin to the foaming agent is 1:(0.0003-0.001).

In this embodiment, by limiting the weight part range of the PVA resin and the foaming agent, the primary product of microporous PVA fiber obtained after foaming and pore forming in Step 5 has a relatively moderate number of micropores and a microporous structure having large specific surface area, and the breaking tenacity of the primary product of microporous PVA fiber will not become too low.

If the amount of foaming agent is too large, it tends to cause too much foaming, which will eventually reduce the breaking tenacity of the primary product of microporous PVA fiber and cause spinning difficulties; and if the amount of foaming agent is too small, it tends to cause insufficient foaming, which might increase the breaking tenacity of the fiber, but will limit its specific surface area, resulting in poor dimensional stability.

It is further preferable that, in Step 2, the weight ratio of the PVA resin to the foaming agent is preferably 1:(0.0006-0.0009).

In this embodiment, when the weight ratio of the PVA resin to the foaming agent is 1:(0.0006-0.0009), the final product of microporous PVA fiber as obtained has excellent breaking tenacity and a microporous structure with large specific surface area.

It is further preferable that, in Step 3, the temperature of the first coagulation bath treatment is 35-55° C., and the speed of the first coagulation bath treatment is 7-9 m/s.

In this embodiment, prepared sodium sulfate solution is used in the first coagulation bath treatment, in which the key component of the sodium sulfate solution is sodium sulfate. The treatment temperature of 35-55° C. is helpful to dissolve the sodium sulfate component in the sodium sulfate solution and make the concentration of the sodium sulfate solution more uniform. The primary PVA fiber obtained via the first coagulation bath treatment has good dehydration effect and good dimensional stability.

It is further preferable that, in Step 3, the temperature of the first coagulation bath treatment is preferably 40-50° C., and the speed of the first coagulation bath treatment is preferably 7 m/s.

In this embodiment, the above temperature range in combination with the above treatment speed is helpful to make the primary PVA fiber obtained by the treatment have better dehydration effect and dimensional stability.

It is further preferable that, in Step 1, the weight ratio of water to calcium hydroxide is 1:(0.006-0.02).

Calcium hydroxide has strong penetration ability by itself without heating. In this embodiment, calcium hydroxide is added to the second coagulation bath treatment in Step 4 to react with the ammonium sulfate obtained by reaction in Step 3 to generate calcium sulfate, ammonia and water. The resulting calcium sulfate can act directly on the surface of the secondary fiber to improve its dimensional stability.

It is further preferred that, in Step 4, the weight ratio of water to calcium hydroxide is preferably 1:(0.011-0.014).

It is found that the secondary fiber obtained by the second coagulation bath treatment has better mechanical properties by adopting the above weight ratio of water to calcium hydroxide.

It is further preferable that, in Step 5, the fiber is heated to 180-250° C. for foaming, and the conveying speed of the secondary fiber is 30-40 m/s.

In the existing wet PVA spinning production process, in the subsequent process of secondary fiber, the fiber is heated in a drying channel between 180-250° C. while stretching. In Step 5, by using this temperate, the ammonium bicarbonate and sodium bicarbonate that are not completely reacted and remain in the secondary fiber are heated and decomposed to $NH_3$ and $CO_2$, which escape from the secondary fiber and leave micropores in the secondary fibers to provide the primary product of microporous PVA fibers. This method makes full use of the heating process of drying the secondary fiber in the drying channel without requiring additional heating, which can not only save energy consumption, but also completely decompose residual ammonium bicarbonate and sodium bicarbonate, so that the primary product of microporous PVA fiber contain more micropores.

It is further preferable that, in Step 5, the temperature of foaming and pore forming is preferably 220-230° C.

In this embodiment, the temperature range can fully thermally decompose the foaming agent and promote the bubble generation of the foaming agent, so that no residual foaming agent remained in the obtained primary product of microporous PVA fiber, which is conducive to remove the possible residual flavor of the foaming agent; and the temperature of the drying channel in the traditional process is 220-230° C., which entails no additional process equipment, facilitating the reduction of production cost.

In summary, the present application has the following beneficial effects:

the present application adopts a specific treatment method comprising the combination of a first coagulation bath by adding a foaming agent-sodium sulfate to the spinning solution—a second coagulation bath by using calcium hydroxide-cleaning-drying, so that the content of sodium sulfate in the reaction system is greatly reduced, which is conducive to reducing the residue of sodium sulfate on the surface of the final microporous PVA fiber, thereby reducing the limitations suffered by microporous PVA fiber in medical use.

A traditional process comprises: foaming-dehydration via a coagulation bath treatment in sodium sulfate-cleaning-drying, in which it takes about 10 tons of water to clean the mirabilite remained on 1 ton of microporous PVA fiber. On the contrary, since the added sodium sulfate is substantially used up in reaction, only 2.5 tons of water is needed to clean 1 ton of microporous PVA fiber. Therefore, the water consumption is greatly saved, and there is only a small amount of sodium sulfate left in the cleaned water, which is conducive to environmental protection and sustainable production.

The foaming agent used in the present application is added at a low temperature, without being decomposed, and appears on the surface and inside of the primary PVA fiber due to the spinning effect, in which the foaming agent present on the surface can react with sodium sulfate to reduce the content of sodium sulfate, and at the same time can be reacted to form auxiliary components (sodium bicarbonate and sodium carbonate) that can be thermally decomposed into gases. The heating operation in Step 5 thermally decomposes the foaming agent inside the secondary fiber and the sodium bicarbonate and sodium carbonate on the surface of the secondary fiber to form bubbles, so that uniform micropores are formed from inside to outside of the secondary fiber, and the final product of microporous PVA fiber has a large specific surface area. At the same time, the foaming agent used in the application tends to leave no toxic and harmful substances after the end of the preparation process, and will not have side effects on the PVA resin.

The present application adopts a treatment method comprising the combination of a first coagulation bath by adding a foaming agent sodium-sulfate to the spinning solution—a second coagulation bath by using calcium hydroxide-cleaning-drying, in which the product formed in the reaction of the foaming agent and the sodium sulfate is reacted with calcium hydroxide to generate calcium sulfate, which is relatively pure and attached onto the surface of the formed secondary fiber. The calcium sulfate will not easily separated from the fiber, even in the process of foaming and pore forming, making the final product of microporous PVA fiber have better dimensional stability and mechanical properties.

DETAILED DESCRIPTION

The application will be further described in detail below in combination embodiments.

Example 1

A method for preparing microporous PVA fiber, includes the following steps:

Step 1: preparing a spinning solution: adding 180 kg of Model 2499 PVA resin and 820 Kg of water into a dissolving kettle, and heating to 95° C. under a slow stirring at a speed of 40 rpm till the PVA resin was completely dissolved to form the spinning solution;

preparing calcium hydroxide solution: thoroughly mixing calcium hydroxide powder and water by a weight ratio of 0.0125:1 to form the calcium hydroxide solution;

preparing sodium sulfate solution: forming sodium sulfate solution with a concentration of 35% from mirabilite and water:

Step 2: preparing PVA spinning stock solution: cooling the spinning solution obtained in Step 1 to 60° C., adding 126 g of ammonium bicarbonate as foaming agent thereto, pressurizing the kettle to 0.3 MPa under a stirring speed of 40 rpm, and stirring for another 30 min to provide the PVA spinning stock solution;

Step 3: spinning and first coagulation bath treatment: conveying the PVA spinning stock solution obtained in Step 2 to a spinneret plate through a pipeline, and subjecting the spinned fiber to a first coagulation bath treatment in the sodium sulfate solution at the temperature of 40° C. and at a treatment speed of 7 m/s, so as to dehydrate the spinned fiber to form a primary PVA fiber;

Step 4: second coagulation bath treatment: reacting the primary PVA fiber obtained in Step 3 with excessive calcium hydroxide solution to provide a secondary fiber;

Step 5: foaming and pore forming: introducing the secondary fiber obtained in Step 4 into a drying channel kept at a temperature of 230° C. for foaming, while stretching the secondary fiber forward at a speed of 35 m/min;

Step 6: cleaning and drying the primary product of microporous PVA fiber obtained in Step 5 to provide the final product of microporous PVA fiber.

Example 2

A method for preparing microporous PVA fiber includes the following steps:

Step 1: preparing spinning solution: adding 190 kg of Model 1799 PVA resin and 810 Kg of water into a dissolving kettle, and heating to 90° C. under a slow stirring at the speed of 40 rpm until the PVA resin was completely dissolved to form the spinning solution;

preparing calcium hydroxide solution: thoroughly mixing calcium hydroxide powder and water by a weight ratio of 0.0125:1 to form the calcium hydroxide solution;

preparing sodium sulfate solution: forming the sodium sulfate solution having a concentration of 35% from mirabilite and water:

Step 2: preparing PVA spinning stock solution: cooling the spinning solution obtained in Step 1 to 41° C., adding 171 g of ammonium bicarbonate as a foaming agent thereto, pressurizing the kettle to 0.3 MPa under a stirring speed of 40 rpm, and stirring for another 30 min to provide the PVA spinning stock solution;

Step 3: spinning and first coagulation bath treatment: conveying the PVA spinning stock solution obtained in Step 2 to a spinneret plate through a pipeline, and subjecting the spinned fiber to a first coagulation bath treatment in the sodium sulfate solution at the temperature of 35° C. by a treatment speed of 7 m/s, so as to dehydrate the spinned fiber to form a primary PVA fiber;

Step 4: second coagulation bath treatment: reacting the primary PVA fiber obtained in Step 3 with excessive calcium hydroxide solution to provide a secondary fiber;

Step 5: foaming and pore forming: introducing the secondary fiber obtained in Step 4 into a drying channel kept at the temperature of 180° C. for foaming, while stretching the secondary fiber forward at a speed of 35 m/min;

Step 6: cleaning and drying the primary product of microporous PVA fiber obtained in Step 5 to provide the final product of microporous PVA fiber.

Example 3

A method for preparing microporous PVA fiber includes the following steps:

Step 1: preparing a spinning solution: adding 180 kg of Model 2499 PVA resin and 820 Kg of water into a dissolving kettle, and heating to 100° C. under a slow stirring at the speed of 40 rpm until the PVA resin was completely dissolved to form the spinning solution;

preparing calcium hydroxide solution: thoroughly mixing calcium hydroxide powder and water by a weight ratio of 0.0065:1 to form the calcium hydroxide solution;

preparing sodium sulfate solution: forming the sodium sulfate solution having a concentration of 35% from mirabilite and water:

Step 2: preparing PVA spinning stock solution: cooling the spinning solution obtained in Step 1 to 60° C., adding 126 g of ammonium bicarbonate as foaming agent thereto, pressurizing the kettle to 0.3 MPa under a stirring speed of 40 rpm, and stirring for another 30 min to provide the PVA spinning stock solution;

Step 3: spinning and first coagulation bath treatment: conveying the PVA spinning stock solution obtained in Step 2 to a spinneret plate through a pipeline, and subjecting the spinned fiber to a first coagulation bath treatment in the sodium sulfate solution at the temperature of 55° C. by a treatment speed of 8 m/s, so as to dehydrate the spinned fiber to form a primary PVA fiber;

Step 4: second coagulation bath treatment: reacting the primary PVA fiber obtained in Step 3 with excessive calcium hydroxide solution to provide a secondary fiber;

Step 5: foaming and pore forming: introducing the secondary fiber obtained in Step 4 into a drying channel kept at the temperature of 250° C. for foaming, while stretching the secondary fiber forward at a speed of 35 m/min;

Step 6: cleaning and drying the primary product of microporous PVA fiber obtained in Step 5 to provide the final product of microporous PVA fiber.

Example 4

A method for preparing microporous PVA fiber includes the following steps:

Step 1: preparing a spinning solution: adding 180 kg of Model 2499 PVA resin and 820 Kg of water into a dissolving kettle, and heating to 90° C. under a slow stirring at the speed of 40 rpm until the PVA resin was completely dissolved to form the spinning solution;

preparing calcium hydroxide solution: thoroughly mixing calcium hydroxide powder and water by a weight ratio of 0.019:1 to form the calcium hydroxide solution;

preparing sodium sulfate solution: forming sodium sulfate solution having a concentration of 35% from mirabilite and water:

Step 2: preparing PVA spinning stock solution: cooling the spinning solution obtained in Step 1 to 60° C., adding 126 g of ammonium bicarbonate as foaming agent thereto, pressurizing the kettle to 0.3 MPa under a stirring speed of 40 rpm, and stirring for another 30 min to provide the PVA spinning stock solution;

Step 3: spinning and first coagulation bath treatment: conveying the PVA spinning stock solution obtained in Step 2 to a spinneret plate through a pipeline, and subjecting the spinned fiber to a first coagulation bath treatment in the sodium sulfate solution at the temperature of 50° C. by a treatment speed of 9 m/s, so as to dehydrate the spinned fiber to form a primary PVA fiber;

Step 4: second coagulation bath treatment: reacting the primary PVA fiber obtained in Step 3 with excessive calcium hydroxide solution to provide a secondary fiber;

Step 5: foaming and pore forming: introducing the secondary fiber obtained in Step 4 into a drying channel kept at the temperature of 220° C. for foaming, while stretching the secondary fiber forward at a speed of 44 m/min;

Step 6: cleaning and drying the primary product of microporous PVA fiber obtained in Step 5 to provide the final product of microporous PVA fiber.

Example 5

A method for preparing microporous PVA fiber, which is different from Example 2 in that, in Step 1, when preparing the spinning solution, 190 kg of Model 1799 PVA resin and 810 kg of water were added to the dissolving kettle, stirred slowly at a stirring speed of 40 rpm and heated to 90° C. or above until the PVA resin was completely dissolved to form the spinning solution. The amount of ammonium bicarbonate used in step 2 was 114 g.

Example 6

A method for preparing microporous PVA fiber, which is different from Example 1 in that, in Step 1, when preparing the spinning solution, 180 kg of Model 2499 PVA resin and 820 kg of water were added to the dissolving kettle, stirred slowly at a stirring speed of 40 rpm and heated to 90° C. or above until the PVA resin was completely dissolved to form the spinning solution. The amount of ammonium bicarbonate used in Step 2 was 54 g.

Example 7

A method for preparing microporous PVA fiber, which is different from Example 1 in that, in Step 1, when preparing the spinning solution, 180 kg of Model 2499 PVA resin and 820 kg of water were added to the dissolving kettle, stirred slowly at a stirring speed of 40 rpm and heated to 90° C. or above until the PVA resin was completely dissolved to form the spinning solution. The amount of ammonium bicarbonate used in Step 2 was 180 g.

Example 8

A method for preparing microporous PVA fiber, which is different from Example 1 in that, in Step 1, the weight ratio of water to calcium hydroxide is 1:0.006.

Example 9

A method for preparing microporous PVA fiber, which is different from Example 1 in that, in Step 1, the weight ratio of water to calcium hydroxide is 1:0.02.

Example 10

A method for preparing microporous PVA fiber, which is different from Example 1 in that, in Step 1, the weight ratio of water to calcium hydroxide is 1:0.011.

Example 11

A method for preparing microporous PVA fiber, which is different from Example 1 in that, in Step 1, the weight ratio of water to calcium hydroxide is 1:0.014.

Example 12

A method for preparing microporous PVA fiber, which is different from Example 1 in that, in Step 1, the foaming agent as added was ammonium carbonate and the use amount of ammonium carbonate was 144 g.

The preparation parameters in the above examples 1-12 are shown in Table 1.

TABLE 1

Parameters of Examples 1-12

| Example | Parameter | | | | | | |
|---|---|---|---|---|---|---|---|
| | PVA (kg) | Foaming agent (kg) | Weight ratio of PVA to foaming agent | Weight ratio of calcium hydroxide to water | Weight ratio of mirabilite to water | | |
| Example 1 | 180 | 0.126 | 0.0007 | 0.0125 | 1 | 0.35 | 0.65 |
| Example 2 | 190 | 0.171 | 0.0009 | 0.0125 | 1 | 0.35 | 0.65 |
| Example 3 | 180 | 0.126 | 0.0007 | 0.0065 | 1 | 0.35 | 0.65 |
| Example 4 | 180 | 0.126 | 0.0007 | 0.019 | 1 | 0.35 | 0.65 |
| Example 5 | 190 | 0.114 | 0.0006 | 0.0125 | 1 | 0.35 | 0.65 |
| Example 6 | 180 | 0.054 | 0.0003 | 0.0125 | 1 | 0.35 | 0.65 |
| Example 7 | 180 | 0.18 | 0.001 | 0.0.125 | 1 | 0.35 | 0.65 |
| Example 8 | 180 | 0.126 | 0.0007 | 0.006 | 1 | 0.35 | 0.65 |
| Example 9 | 180 | 0.126 | 0.0007 | 0.02 | 1 | 0.35 | 0.65 |
| Example 10 | 180 | 0.126 | 0.0007 | 0.011 | 1 | 0.35 | 0.65 |
| Example 11 | 180 | 0.126 | 0.0007 | 0.014 | 1 | 0.35 | 0.65 |
| Example 12 | 180 | 0.144 | 0.0007 | 0.0125 | 1 | 0.35 | 0.65 |

Comparison Example 1

A method for preparing PVA fiber, which is different from Example 1 in that, in Step 2, the amount of added ammonium bicarbonate was 80 g.

Comparison Example 2

A method for preparing PVA fiber, which is different from Example 1 in that:

in Step 1, when preparing the calcium hydroxide solution, the calcium hydroxide powder and water were thoroughly mixed by a weight ratio of 0.0031:1; and in Step 2, the amount of added ammonium bicarbonate was 140 g. [moo] The preparation parameters of the above Comparison Examples 1-2 are shown in Table 2.

TABLE 2

Parameters for Comparison Examples 1-2

| Comparison Example | Parameter | | | | | | |
|---|---|---|---|---|---|---|---|
| | PVA (kg) | Foaming agent (kg) | Weight ratio of PVA to foaming agent | Weight ratio of calcium hydroxide to water | | Weight ratio of mirabilite to water | |
| Comparison Exm.l | 180 | 0.08 | 0.00044 | 0.0125 | 1 | 0.35 | 0.65 |
| Comparison Exm.2 | 180 | 0.14 | 0.00078 | 0.0031 | 1 | 0.35 | 0.65 |

Comparison Example 3

A method for preparing PVA fiber, which is different from Example 1 in that, during the operation, 134 g sodium bicarbonate was used as the foaming agent, instead of ammonium bicarbonate.

Comparison Example 4

A method for preparing PVA fiber, which is different from Example 1 in that, during the operation, sodium hydroxide solution of equal concentration was used instead of calcium hydroxide solution.

Comparison Example 5

A method for preparing PVA fiber, which is different from embodiment 1 in that, ammonium bicarbonate and calcium hydroxide solution were not added.

Test Experiments

The test was made by following reference standard GB/T14335-2008, and the residual sodium sulfate was tested by sintering and weighing method.

Test instruments: a muffle furnace, a chemical fiber fineness analyzer, a fiber length analyzer, a Micronaire instrument, a Model YG008 multifilament strength tester.

Test results: the test results for the Examples are shown in Table 3; and the test results for the Comparison Examples are shown in Table 4.

TABLE 3

Test results for the Examples

| Example | Testing indicators | | | |
|---|---|---|---|---|
| | Void fraction/% | Shrinkage rate/% | Breaking tenacity (1.2 dtex) | Amount of sodium sulfate residue on fiber/% |
| Example 1 | 21 | 3 | 4.9 cN/dtex | 0.0029 |
| Example 2 | 19 | 3 | 4.9 cN/dtex | 0.0029 |
| Example 3 | 19 | 3 | 4.7 cN/dtex | 0.0028 |
| Example 4 | 20 | 3 | 4.8 cN/dtex | 0.0029 |
| Example 5 | 19 | 3 | 4.9 cN/dtex | 0.0029 |
| Example 6 | 20 | 3 | 4.8 cN/dtex | 0.0028 |
| Example 7 | 20 | 3 | 4.9 cN/dtex | 0.0027 |
| Example 8 | 19 | 3 | 4.9 cN/dtex | 0.0028 |
| Example 9 | 20 | 3 | 4.8 cN/dtex | 0.0028 |
| Example 10 | 19 | 3 | 4.8 cN/dtex | 0.0028 |

TABLE 3-continued

Test results for the Examples

| Example | Testing indicators | | | |
|---|---|---|---|---|
| | Void fraction/% | Shrinkage rate/% | Breaking tenacity (1.2 dtex) | Amount of sodium sulfate residue on fiber/% |
| Example 11 | 19 | 3 | 4.9 cN/dtex | 0.0027 |
| Example 12 | 18 | 3 | 4.6 cN/dtex | 0.0028 |

TABLE 4

Test results for Comparison Examples

| Comparison Exm. | Testing indicators | | | |
|---|---|---|---|---|
| | Void fraction/% | Shrinkage rate/% | Breaking tenacity (1.2 dtex) | Amount of sodium sulfate residue on fiber/% |
| Comparison Exm. 1 | 7 | 5 | 5.7 cN/dtex | 0.061 |
| Comparison Exm. 2 | 19 | 6 | 2.1 cN/dtex | 0.0029 |
| Comparison Exm. 3 | 11 | 3 | 5.1 cN/dtex | 0.077 |
| Comparison Exm. 4 | 19 | 5 | 3.4 cN/dtex | 0.0026 |
| Comparison Exm. 5 | 0 | 6 | 2.0 cN/dtex | 0.1 |

It can be seen from Table 3 and Table 4 that, in Examples 1-12, the void fraction can reach 19-21%, the shrinkage rate is 3%, the fiber breaking tenacity is 4.7-4.9 cn/dtex, and the amount of sodium sulfate residue on the fiber is 0.0027-0.0029%.

In comparison with Examples 1-12, although the breaking tenacity in the Comparison Example 1 is better than those of Example 1-12, the void fraction in Comparison Example 1 is lower, and the amount of the sodium sulfate residue on the fiber and shrinkage rate are higher, showing that the hydrophilic property of the fiber is poor, and thus it is not suitable for use in the field of medical materials. The main reason for the above difference is that, insufficient amount of ammonium bicarbonate added in the Comparison Example 1 resulted in poor foaming effect, and the insufficient amount of the foaming agent caused more obvious shrinkage since the same sodium sulfate solution as in Examples 1-12 was used.

In comparison with the Examples 1-12, the void fraction and the amount of sodium sulfate residue on the fiber in the Comparison Example 2 are similar to those the Examples 1-12, but the shrinkage rate is too high and the breaking tenacity is too low; and, in despite of the fact that the PVA fiber used as a medical material does not need too high breaking tenacity, a breaking tenacity (1.2 dtex) of only 2.1 cn/dtex makes it difficult to meet the requirements in the field of medical materials. The main reasons for the above differences lie in that, less amount of calcium hydroxide used in the Comparison Example 2 formed a lower concentration of the calcium hydroxide solution, finally resulting in less calcium sulfate formed in the reaction and less adhesion on the surface of the obtained PVA fiber. Therefore, the PVA fiber as obtained tended to have poor dimensional stability, higher shrinkage rate and lower breaking tenacity. Therefore, the concentration of calcium hydroxide solution has a great influence on the mechanical properties and dimensional stability of the finally obtained PVA fiber.

Compared with Examples 1-12, the foaming rate is lower and the amount of sodium sulfate residue on the fiber is higher in Comparison Example 3, resulting in that the formed PVA fiber has a poor hydrophilicity and a great damage to the skin, making it not suitable for use in the field of medical materials. The main reasons for the above differences lie in that, sodium bicarbonate used as foaming agent in Comparison Example 3 can produce foaming effect, but can not produce the foaming effect as good as that of ammonium bicarbonate; moreover, it is difficult to react with sodium sulfate, so that it can not remove sodium sulfate, resulting in more sodium sulfate remained on the surface of PVA fiber. The results show that ammonium bicarbonate or ammonium bicarbonate has better foaming effect, and it is beneficial to reduce the content of residual sodium sulfate remained on the surface of the obtained PVA fiber.

Compared with Examples 1-12, the shrinkage rate is too high and the breaking tenacity is too low in Comparison Example 4, making it difficult to meet the requirements in the field of medical materials. The main reason for the difference is that, it is difficult for the sodium hydroxide solution used in Comparison Example 4 to form a substance attached to the outer surface of PVA fiber and improving the mechanical properties thereof. The results show that the calcium sulfate and calcium carbonate obtained in the process of preparation can improve the breaking tenacity of the PVA fiber.

Compared with Examples 1-12, in Comparison Example 5, the obtained PVA fiber is not foamed, the shrinkage rate is too high, the breaking tenacity is too low, and the amount of the sodium sulfate residue on the fiber makes the obtained PVA have poor hydrophilicity, poor mechanical properties, and damage to the skin when contacting the skin, making it difficult to meet the requirements in the field of medical materials. The main reason for the above difference is that, ammonium bicarbonate and calcium hydroxide solution were not used in Comparison Example 5. The result shows that the coordination of ammonium bicarbonate and calcium hydroxide can improve the foaming effect of PVA fiber, increase its hydrophilicity, and provide it with moderate breaking tenacity, making it suitable for use in the field of medical materials.

These specific examples only represent an explanation to the present application, but not a limitation to the present application. After reading the specification, modifications to the examples based on demands can be made by those skilled in the art based on demands, without paying any creative contribution, which will be protected by the patent law as long as they fall within the scope of the claims of the application.

What is claimed is:

1. A method for preparing microporous PVA fiber comprising the following steps:

Step 1: preparing a spinning solution: mixing raw material PVA resin with water and heating to dissolve the raw material PVA resin completely to form the spinning solution;

preparing a calcium hydroxide solution: mixing calcium hydroxide powder with water to form the calcium hydroxide solution; and preparing a sodium sulfate solution: forming the sodium sulfate solution with a concentration of 35% from mirabilite and water;

Step 2: preparing a PVA spinning stock solution: cooling the spinning solution obtained in Step 1 to 40-60° C., and adding a foaming agent thereto to provide the PVA spinning stock solution;

Step 3: spinning and first coagulation bath treatment: spinning the PVA spinning stock solution obtained in Step 2, and subjecting a spun fiber to a first coagulation bath treatment in the sodium sulfate solution for dehydration to provide a primary PVA fiber;

Step 4: second coagulation bath treatment: reacting the primary PVA fiber obtained in Step 3 with the calcium hydroxide solution to provide a secondary fiber;

Step 5: foaming and pore forming: heating to foam the secondary fiber obtained in Step 4 while stretching to form a primary product of microporous PVA fiber; and Step 6: cleaning and drying the primary products of microporous PVA fiber obtained in Step 5 to provide the final product of microporous PVA fiber;

wherein the foaming agent is one selected from the group consisting of ammonium carbonate and ammonium bicarbonate.

2. The method for preparing microporous PVA fiber according to claim 1, wherein the foaming agent in Step 2 is ammonium bicarbonate.

3. The method for preparing microporous PVA fiber according to claim 1, wherein, in Step 2, the weight ratio of the PVA resin to the foaming agent is 1:(0.0003-0.001).

4. The method for preparing microporous PVA fiber according to claim 3, wherein, in Step 2, the weight ratio of the PVA resin to the foaming agent is 1:(0.0006-0.0009).

5. The method for preparing microporous PVA fiber according to claim 1, wherein, in Step 3, the temperature of the first coagulation bath treatment is 35-55° C., and the speed of the first coagulation bath treatment is 7-9 m/s.

6. The method for preparing microporous PVA fiber according to claim 5, wherein, in Step 3, the temperature of the first coagulation bath treatment is 40-50° C., and the speed of the first coagulation bath treatment is 7 m/s.

7. The method for preparing microporous PVA fiber according to claim 1, wherein, in Step 1, the weight ratio of water to calcium hydroxide is 1:(0.006-0.02).

8. The method for preparing microporous PVA fiber according to claim 1, wherein, in Step 4, the weight ratio of water to calcium hydroxide is 1:(0.011-0.014).

9. The method for preparing microporous PVA fiber according to claim 1, wherein, in Step 5, the fiber is heated to 180-250° C. for foaming, and the conveying speed of the secondary fiber is 30-40 m/s.

10. The method for preparing microporous PVA fiber according to claim 1, wherein, in Step 5, the temperature of foaming and pore forming is 220-230° C.

* * * * *